US005667139A

United States Patent [19]

Dickie

[11] Patent Number: 5,667,139

[45] Date of Patent: Sep. 16, 1997

[54] CLEANING APPARATUS FOR HEAT EXCHANGE SURFACES AND AN IMPROVED NOZZLE DEVICE THEREFOR

[75] Inventor: Douglas Grant Dickie, Glasgow, Great Britain

[73] Assignee: Clyde Forest Limited, Glasgow, Great Britain

[21] Appl. No.: 436,337

[22] PCT Filed: Nov. 11, 1993

[86] PCT No.: PCT/GB93/02322

§ 371 Date: Jun. 23, 1995

§ 102(e) Date: Jun. 23, 1995

[87] PCT Pub. No.: WO94/11694

PCT Pub. Date: May 26, 1994

[30] Foreign Application Priority Data

Nov. 12, 1992 [GB] United Kingdom ..... 9223679

[51] Int. Cl.[6] ..... B05B 3/00

[52] U.S. Cl. ..... 239/263.3; 239/290; 239/424; 239/566; 15/316.1; 15/317; 122/390; 122/392

[58] Field of Search ..... 239/105, 227, 239/263.3, 423, 290, 424, 424.5, 554, 566; 15/316.1, 317; 122/390, 392; 134/168 C, 172, 177

[56] References Cited

U.S. PATENT DOCUMENTS

| | | | |
|---|---|---|---|
| 2,897,532 | 8/1959 | Cantieri | 15/317 |
| 4,498,213 | 2/1985 | Zalewski | 15/316.1 |
| 4,583,496 | 4/1986 | Albers et al. | 122/390 X |
| 5,002,120 | 3/1991 | Boisture et al. | 15/316.1 X |
| 5,230,306 | 7/1993 | Barringer et al. | 122/392 X |

*Primary Examiner*—Andres Kashnikow
*Assistant Examiner*—Steven J. Ganey
*Attorney, Agent, or Firm*—Rhodes, Coats & Bennett, L.L.P.

[57] ABSTRACT

A nozzle configuration capable of handling several cleaning mediums including two sets of discharge nozzles, each of which is associated with a respective cleaning medium. The first nozzle set discharges cleaning medium fluid of relatively higher pressure, while the second nozzle set has nozzles of relatively larger throat diameter for the discharge of relatively lower pressure medium. The nozzles of the second set are arranged coaxially with and downstream from the nozzles of the first set, whereby cleaning medium fluid discharged from the first nozzle set passes through the throats of the nozzles of the second set without substantial obstruction therein.

23 Claims, 8 Drawing Sheets

CLEANING APPARATUS FOR HEAT EXCHANGE SURFACES AND AN IMPROVED NOZZLE DEVICE THEREFOR

The present invention relates to cleaning apparatus for use in cleaning heat exchange surfaces, especially but not exclusively in regenerative heat exchangers, and more particularly concerns a novel nozzle device for jets of cleaning medium in such apparatus.

Heat exchanger cleaning apparatus is known which functions to provide jets of cleaning medium which impinge on heat exchange surfaces of the heat exchanger to remove coatings or barrier layers which have built up on the surfaces, these barrier layers being formed by the presence of contaminants in heating gas, for example combustion gas from a furnace, passing over the heat exchange surfaces. These barrier layers are generally of a non-conductive form and hence seriously detract from heat exchange performance. The heat exchange surfaces can be formed by tubes or places, and the surfaces may be static, or may move for example for rotary regenerative heat exchange.

In many applications cleaning apparatus of several types generically known as "sootblowers" are fitted as ancillary equipment and used periodically to remove the barrier layer so as to restore heat transfer efficiency and gas flow pressure differential as closely as possible to the clean surface performance design datum. A jet (or jets) of cleaning medium fluid is projected at such mass flow rate and velocity as will ensure sufficient residual energy at point of impact to dislodge contaminant particles adhering to the heat transfer surface, whereupon the particles will migrate from the surface by gravity or by re-entrainment in the gas flow. The cleaning medium is generally pressurized dry saturated or superheated steam, compressed air or some other gaseous fluid, and in some installations temporary provision can be made for passing mains pressure water through the same nozzle or nozzles (or ancillary dedicated nozzle or nozzles) for washing the heat transfer surfaces when off-load.

The heat exchange surfaces can be static, and a sootblower can be designed to move its nozzle or nozzles continuously during operation relative to the static surfaces in such a way as to maximize the proportion of surface area exposed to impact from the cleaning jet or jets. A conventional sootblower therefore may incorporate the means of admitting one or two alternative cleaning media to one or more commonly shared nozzles, and to move the nozzle or nozzles in a predetermined pattern relative to static heat transfer surfaces such as to optimize cleaning effectiveness.

The alternative concept of rotary regenerative heat exchange between two gaseous fluids at different temperatures employs heat exchangers in which moving solid components e.g. corrugated plate packs are heated during passage through ducting containing the hotter of the two fluids, pass through a seal separating the two fluids, and then discharge their acquired heat during passage through the ducting containing the colder of the two fluids. Typical applications are the preheating of combustion air by utilizing residual heat in boiler exhaust gases, or the re-heating of cool gases by transferring heat from gas at a higher temperature from some other part of the gas handling process. The corrugated plates are arranged in a plane parallel to the axis of a hub about which they are arranged circumferentially, and relative to each other in a laminer manner, with the fluid passing axially through each interplate cavity width determined by the design of the corrugations. The hub rotates slowly, and in so doing moves the plate assemblies alternately between the hot and cold fluid ducts. As with static flat plate heat exchangers, the interplate cavities may become partially blocked, reducing their ability to absorb and discharge heat, and increasing both the gas pressure drop in the direction of gas flow and the risk of fire.

In these types of heat exchangers the heat bearing plates move relative to the static sootblower locations, and the nozzle or nozzles remain stationery for one or more rotations of the hub, discharging jets of cleaning medium along a circumferential path or paths relative to the centre of rotation. The sootblower and its associated controls are designed to then index the nozzle or nozzles to new radial positions relative to the hub, where a new circumferential cleaning path is described during the following rotation or rotations. The number and pitching of the nozzles and the stroke of the sootblower are selected to suit the radial coverage required for the size of rotary regenerative heat exchanger involved, with due regard to the availability of blowing medium and to the stand-out distance of the sootblower drive mechanism from the heat exchanger casing.

Even with regular use of such cleaning apparatus providing compressed air and mains water cleaning medium at a frequency of operation compatible with the rate of fouling, some inner parts of the regenerative plate assemblies retain depositions which build up in a cumulative manner and which require to be removed by the application of high pressure water jets with the ability to cut through the deposits so that desirably a high pressure water jetting system should be incorporated in the cleaning apparatus.

U.S. Pat. No. 4141754 shows a sootblower which can serve to discharge relatively low pressure cleaning medium, e.g. gas or steam and relatively high pressure cleaning medium, e.g. high pressure water jets separately via the same outlet ducting. In particular a series of low pressure nozzles serve for the discharge of low or medium pressure gas or steam into respective discharge tubes, while relative high pressure nozzles are located in these discharge tubes, i.e. downstream from the low pressure nozzles for the discharge of a high pressure cleaning medium, e.g. high pressure water, when necessary and generally more intermittently. The fluid flow from the low pressure nozzles into the discharge tubes simultaneously induces exhaust gas or air into these tubes by suction for admixture with the fluid. The low pressure and high pressure nozzles are fed with cleaning medium via separate respective supply conduits. The sootblower of U.S. Pat. No. 4,141,754 has the disadvantage that cleaning fluid flowing in the discharge ducts as a result of fluid discharge from the low pressure nozzles, generally the more used cleaning fluid discharge, is to a substantial degree obstructed by the downstream high pressure nozzles in these discharge ducts and also by the portions of the supply conduits for these nozzles in the discharge ducts. This will disturb the flow pattern of the cleaning fluid flow passing from the discharge ducts and this can lead to a reduction in the effectiveness of cleaning by the fluid.

It is the principal object of the present invention to enable the provision of a sootblower overcoming the above disadvantage but still capable of handling conveniently a number of cleaning mediums, specifically steam or compressed air for routine periodic removal of solid particles, low pressure water for washing heat retaining plates and high pressure water for cutting through and removing very obstinate deposits when required.

Therefore according to the present invention there is provided cleaning apparatus for cleaning heat transfer surfaces in a heat exchanger and capable of handling several cleaning mediums of different characteristics, said cleaning apparatus comprising outlet means incorporating nozzle means for discharging cleaning mediums onto said heat transfer surfaces, conduit means for delivering cleaning medium to said outlet means and inlet means for supplying cleaning mediums to the conduit means, said nozzle means comprising two sets of discharge nozzles each of which sets is associated with a respective cleaning medium a first on of said nozzle sets having nozzles for the discharge of relatively higher pressure medium, while the second nozzles of relatively larger throat diameter serve for the discharge of relatively lower pressure medium, said first and second nozzle sets being adapted for fluid communication with separate respective first and second conduit means whereby each nozzle set receives its respective cleaning medium, said first conduit means being adapted to deliver high pressure water wherein said second nozzle set for the lower pressure medium is located downstream of said first nozzle set for the higher pressure medium, and wherein the nozzles of said second set are arranged coaxially with nozzles of said first set whereby cleaning medium discharge from the first nozzle set passes through the throats of the nozzles of the second nozzle set so enabling cleaning medium discharged selectively from both the nozzle sets to pass from the outlet means without substantial obstruction.

Preferably, each nozzle set comprises a plurality of nozzles, each nozzle of said one set discharging through a corresponding nozzle of the other set.

Preferably, the nozzle sets are adapted to discharge laterally relative to said conduit means, and preferably each set includes two side-by-side array of nozzles.

In a preferred embodiment the conduit means are movable longitudinally relative to casing means of the cleaning apparatus to vary the position of the outlet means and in a retracted position are located substantially wholly within said casing means with only a tip portion located externally. The tip portion preferably comprises material resistant to corrosion in a hostile environment.

Preferably the nozzle means are located within a dedicated static protective cover means in the retracted condition. Preferably, the protective cover means comprises an annular shroud and an end wall, the end wall including an aperture for through passage of the conduit means. The protective cover means can be adapted to receive a flow of sealing medium, e.g. pressurised air.

Preferably the first, smaller sized nozzles serve to deliver high pressure liquid e.g. water while the second larger sized, nozzles serve to deliver selectively one of pressurised steam or air or low pressure liquid (water).

Preferably said first conduit means includes a movable lance portion and a static input feed portion, and inlet means for passing cleaning medium to said first conduit means and second movable conduit means for a second cleaning medium extending into said lance portion, said static conduit portions being off-set relative to said lance portion and having a section within said lance portion beside which section the second conduit means extend.

Preferably, said lance portion and the second conduit means extend substantially concentrically adjacent said outlet means.

Preferably, the second conduit means comprises a rigid tube part within said lance portion, and a flexible tube part connected at one end to the rigid part and located outwith said lance portion. In a preferred embodiment the flexible tube part passes around a pulley wheel and has its other end fixed at a static point, the pulley wheel being mounted for conforming movement with the lance portion while said static fixing point is spaced from the pulley wheel towards said outlet means.

Preferably, the outer end of said lance portion remote from the outlet means is secured to a support block of a carriage facilitating movement of the lance portion, said block including an aperture for said static input feed portion such that said static feed portion enters the lance portion eccentrically sealing means being provided for the static feed portion at the block.

Preferably, the lance portion includes a lateral housing facilitating extension of the rigid tube part outwith the lance portion. Support rollers can be provided for the lance portion adjacent the outlet means.

Drive means can be provided for simultaneous linear movements of the lance portion and the pulley wheel.

An embodiment of the present invention will now be described by way of example with reference to the accompanying drawings in which:

FIGS. 1A, 1B and 1C show a side view in part section (through section A—A of FIGS. 2A/B) of consecutive sections of a unitary sootblower embodying the present invention; while

Figure 1A:
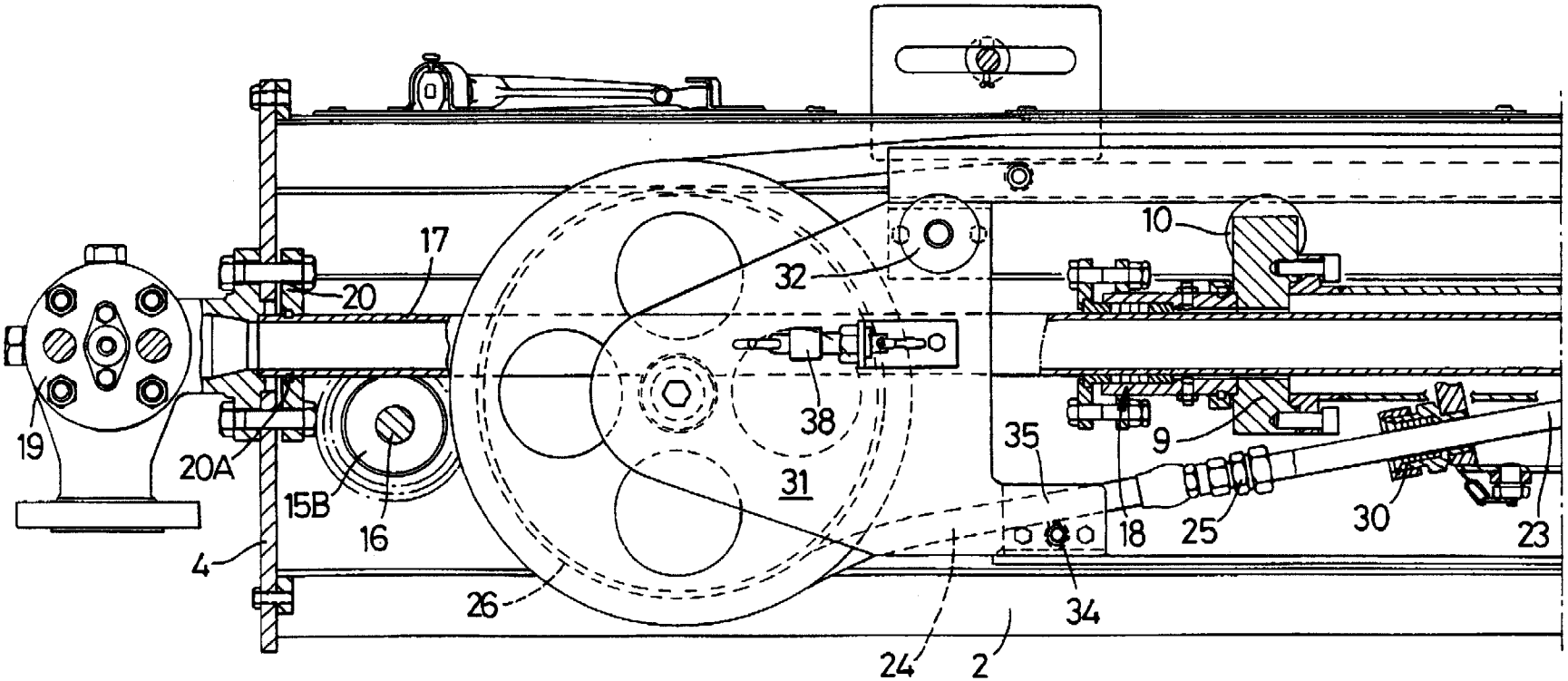
Figure 1B:
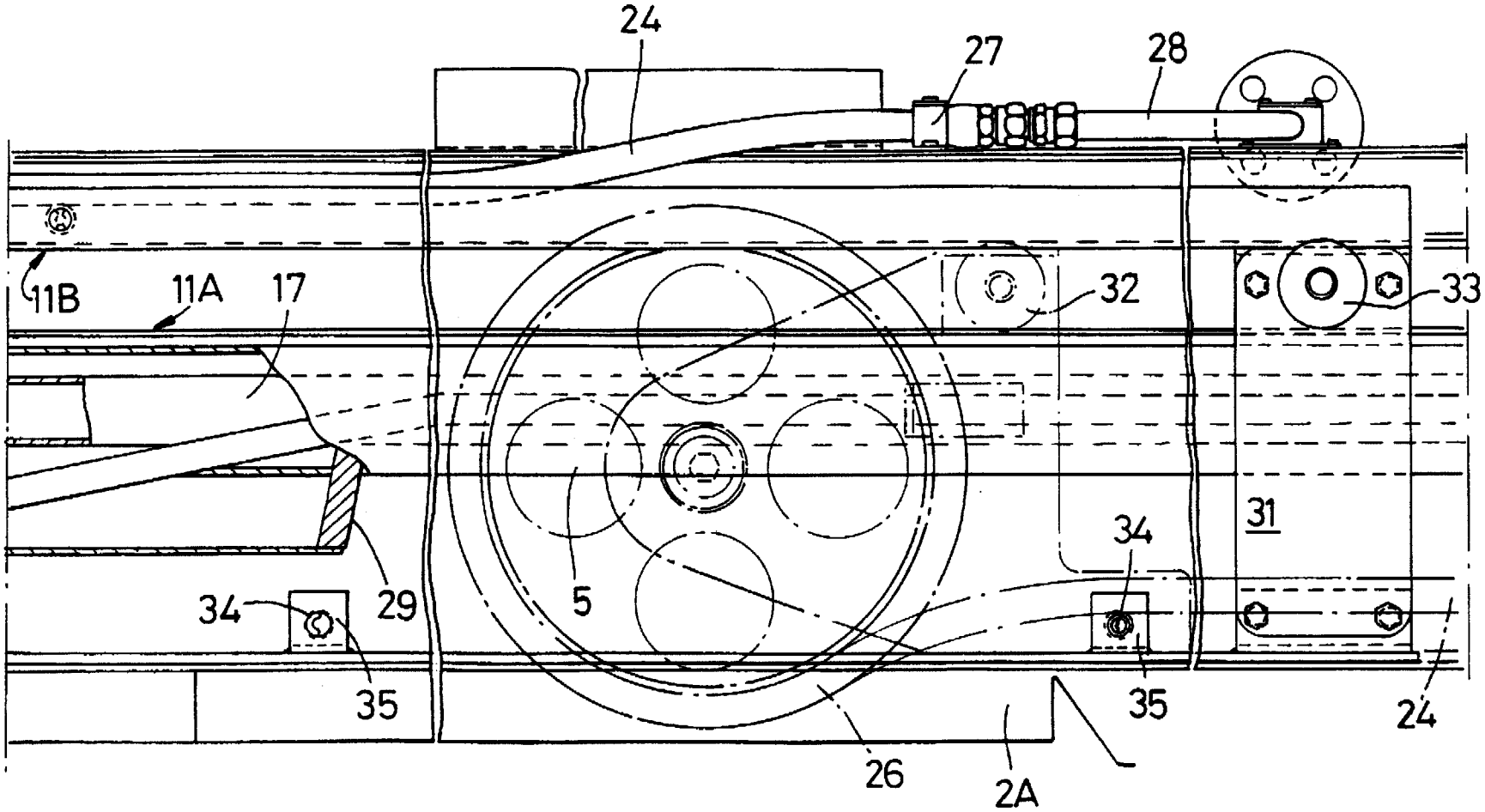

Referring to the drawings, a sootblower 1 for cleaning heat transfer surfaces, especially the surfaces of heat exchange plate elements in a rotary regenerative pre-heater, comprises an elongate casing structure 2 constructed for example from steel channels and plates including an inner end place 3 and outer end plate 4, a movable conduit for cleaning medium in the form of a hollow lance 5 of circular cross-section within the casing 2 and extending outwith the casing 2 at the outer plate end 3, a nozzle assembly 6 an the inner end of the lance 5 defining an outlet discharge for cleaning medium, and a drive including an electric motor 7 and gear box 8 for moving the lance 5. A flanged outer end of the lance 5 is bolted to a carriage block 9 supporting rollers 10 running on elongate guide surfaces 11A, 11B, while the lance 5 is further supported by rollers 12 carried by the inner end plate 3. Driving of the lance 5 is via an endless chain 13 linked to the carriage block 9 via a coupling 14, the chain 13 being trained around end sprockets 15A, 15B, the outer sprocket 15B being keyed to a transverse shaft 16 constituting an output from the gear box 8.

Cleaning medium is supplied to the lance 5 via a static input feed tube 17 passing through the block 9 and into the lance 5, a gland seal 18 carried by the block 9 providing a seal between the tube 17 and the moving lance 5. A valve 19 regulated by air diaphragm 19B controls the flow of cleaning medium to the tube 17, the valve being located on the outer end plate 4 via a spigot while the outer end of the tubde 17 is held firmly against a valve outlet spigot by bolts acting on a draw plate 20 secured to the tube 17 by a circular clip 20A.

The nozzle assembly 6 comprises a first array of nozzles 21 serving for the discharge of a high pressure cleaning medium and a second array of nozzles 22 through which the first nozzles 21 discharge, the second nozzle array 22 located on the lance periphery adjacent the tip serving for the discharge of different cleaning mediums, specifically pressurised air and low pressure (mains) water. Cleaning medium flow to the second nozzle array 22 is via the feed tube 17 and lance 5.

Figure 2A:
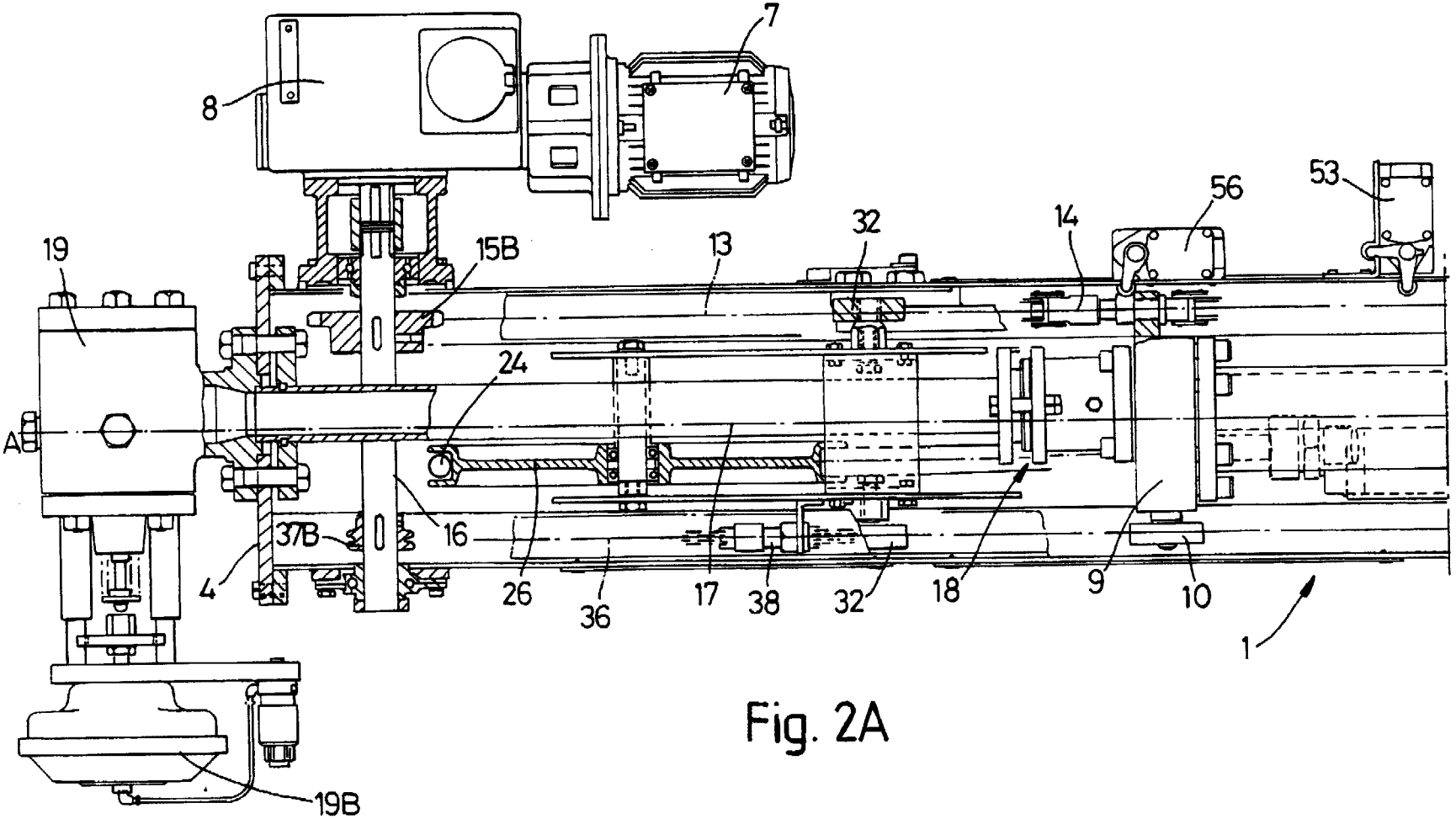
FIGS. 2A, 2B and 2C are the corresponding plan views in partial section.
Figure 2B:
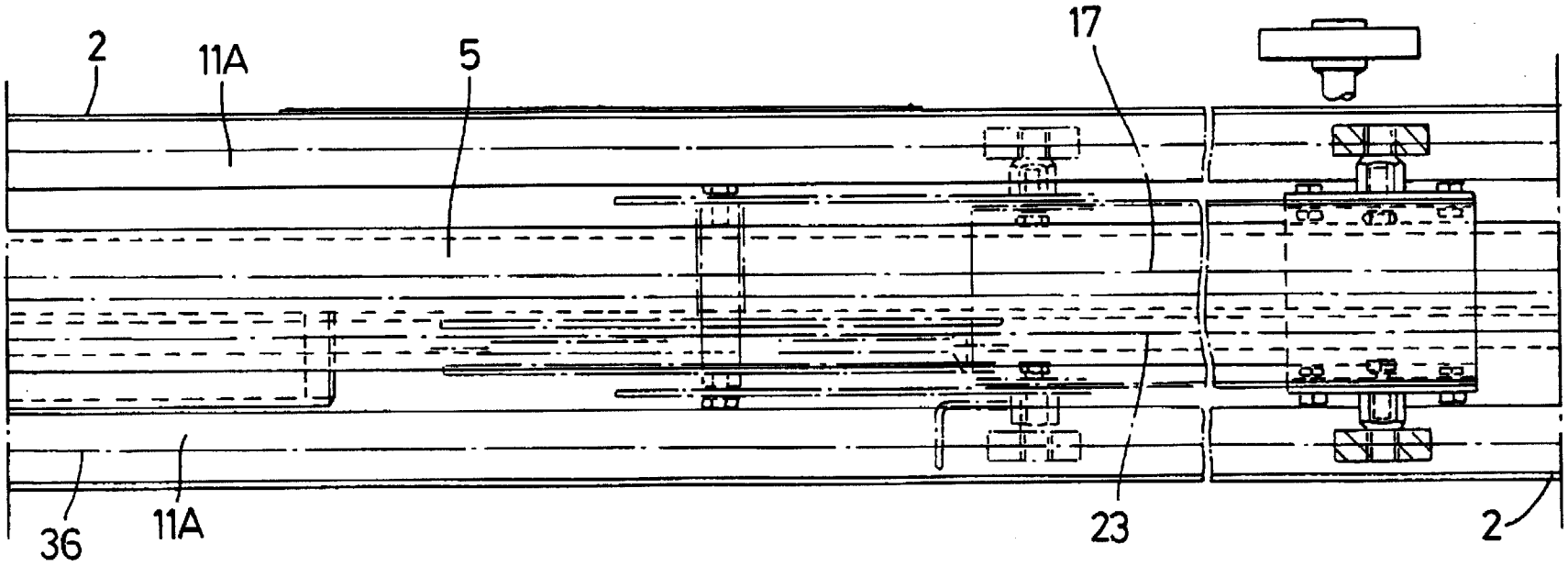
Figure 2C:
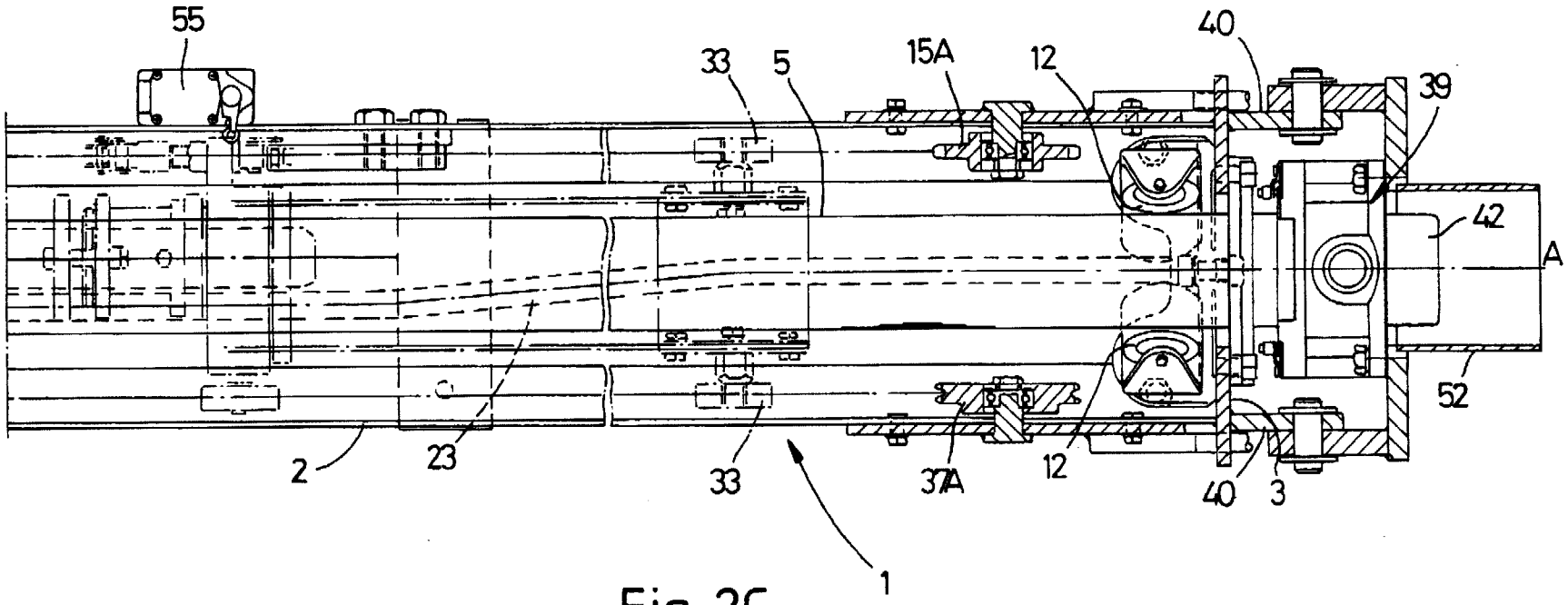
Figure 3:
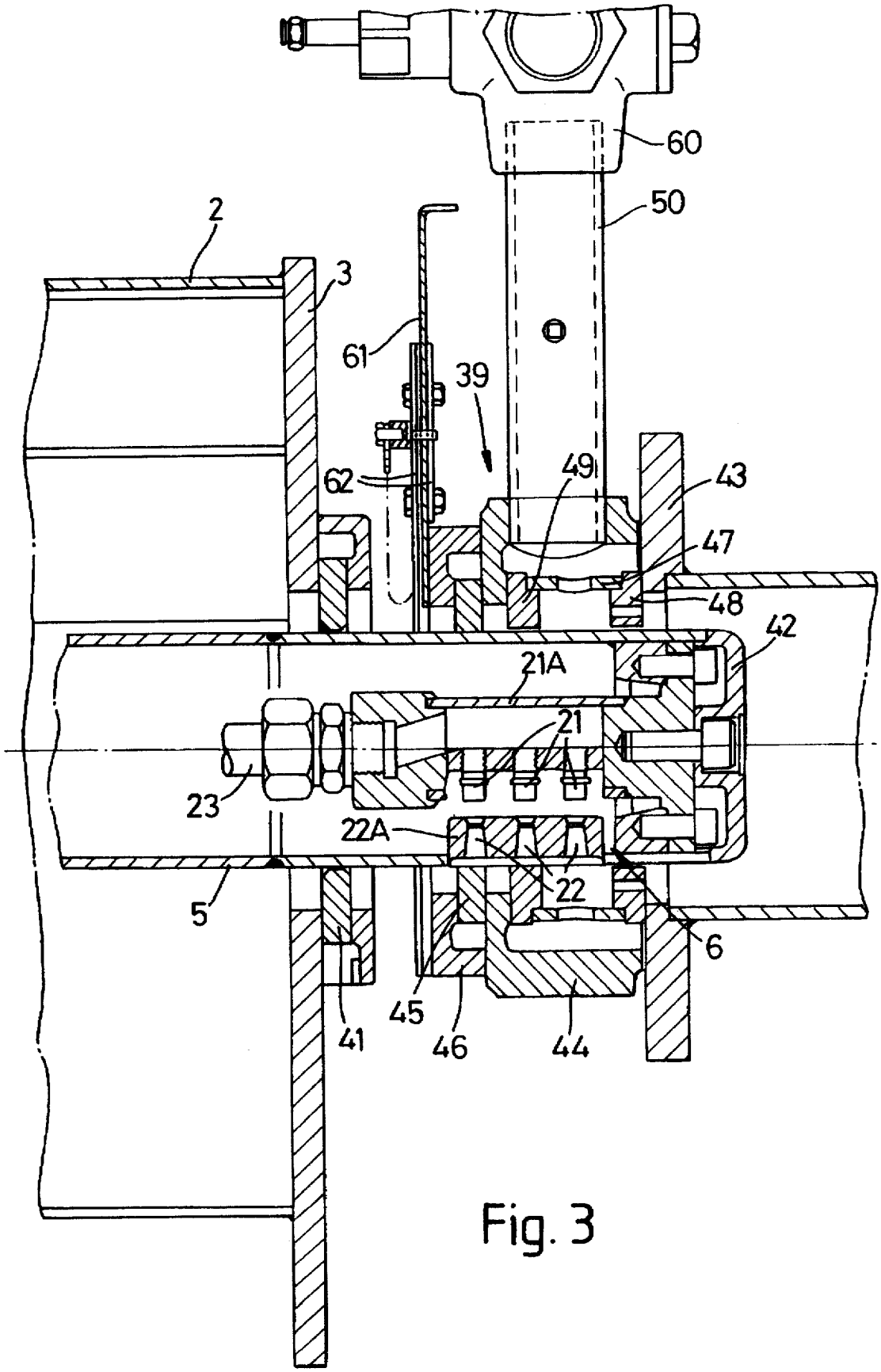
FIG. 3 shows the discharge nozzle arrangement to a large scale.

As will be appreciated, pressure fluid within the lance 5 will tend to extend the lance 5 (in the manner of a fluid ram) and in fact during lance 5 extension during cleaning the role of this chain drive (7, 8, 13) is essentially one of movement containment i.e. holding back of the lance. This characteristic makes it undesirable, in practice, to route high-pressure liquids through the feed tube 17 and lance 5, and there is provided therefore a separate delivery route to the high pressure nozzle array 21. More especially this separate delivery comprises a rigid tube 23 within the lance 5 and coupled to manifold 21A of the nozzles 21, and a flexible hose 24 outwith the lance 5 connected at one end to a projecting portion of the tube 23 via a coupling 25. The hose 24 passes around a pulley wheel 26 and has its other end fixed by a fixing element 27 on the casing 2, a short external input pipe 28 feeding to the hose 24. To assist external passage of the pipe 23, the lance 5 includes a side extension casing 29 whereby a gland seal 30 for the pipe 23 can be located conveniently. The tube 23 runs initially side-by-side with the static feed tube 17 and then curves so as to be concentric with the lance 5 adjacent the inner end—this facilitates appropriate location of nozzle manifold 21A relative to manifold 22A of the nozzles 22—and a particular feature of the apparatus is that the feed tube 17 is radially off-set relative to the lance 5 (as can be seen in FIGS. 2A/B), the block 9 being apertured appropriately to receive the tube 17. This arrangement assists location of the tube 23 within the lance 5.

The pulley wheel 26 is carried by a carriage 31 including rollers 32, 33 running on the guides 11A, 11B the carriage 31 comprising side members linked by cross-bars 34 carried by lugs 35. The carriage 31 is driven from the input shaft 16 via a chain drive comprising separate chain 36 and end sprockets 37A, 37B, the carriage 31 being coupled to the chain 36 by means of a connector 38 while driving is via sprocket 37B. To ensure that payout of the hose 24 is compatible with the movement of carriage 9 (and lance 5), and so enable the runs of the hose to change in the desired manner, the carriage 31 is driven at exactly half the speed of the carriage 9 and this is achieved by having the sprocket 37B half the size of sprocket 15B. The hose fixing element 27 is positioned at a mid-location on the casing 2 so that this element 27 is always spaced from the pulley wheel 26 towards the inner end of the casing 2. The casing 2 includes a sub-portion 2A for accommodation of the pulley wheel 26. In the retracted condition the lance 5 is substantially wholly located within the casing 2, only a small tip portion being positioned externally so that in use in this condition, very little of the lance 5 will be subject to heated gases and this is beneficial in avoiding corrosion in the lance, especially as heated gas may present a decidedly hostile environment. Further, the tip portion housing the nozzle assembly 6 is essentially located in a protective housing or wallbox 39 when the lance is in the retracted condition, the wallbox 39 being pinned to brackets 40 on the casing end wall 3. The lance aperture in the wall 3 includes a seal plate 41 clamped to the wall 3. Only the lance tip including cap 42 may be subject to extensive corrosion attack and to resist such attack this tip can be formed with a suitable anti-corrosion material or coating e.g. a glass coating. The wallbox 39 comprises an inner wall 43, a peripheral wall 44, a lance sealing plate 45 clamped to the wall 44 by a clamp ring 46, and a perforated shroud 47 located between cheek plates 48, 49. It is necessary that pressurized noxious gases are contained within the heat exchanger at the position where the sootblower 1 enters the heat exchanger i.e. at the wallbox 39, and do not tend to discharge via the sootblower. To meet this requirement pressurised air is supplied to the wallbox 39 via an air inlet 50 and at a pressure somewhat greater than that of the gases within the heat exchanger so than this pressurised air constitutes a sealing medium in the wallbox. In particular the arrangement can be such that this air sealing medium creates an air leakage into the gas ducting of the heat exchanger and possibly also to atmosphere through whatever clearances exist in the assembly. The use of the single lance of circular cross section promotes the effectiveness of the seal, while still allowing all necessary cleaning mediums to be supplied (selectively) by the sootblower. It is particularly intended that these cleaning mediums comprise (1) pressurised air and (2) low pressure (mains) water, both of which are delivered via the nozzle array 22, and (3) high pressure water, delivered via the nozzle array 21.

As the lance 5 is extended (see FIGS. 4A,B) its ever increasing exposed length behaves as an unsupported cantilever, so that there would be a tendency if uncorrected for the lance tip containing the nozzle assembly 6 to droop, and consequently move closer and closer to the heat exchange element of the heat exchanger. As generally it is not practicable to have any form of support for the lance in the heat exchanger, the guides 11A/11B are arranged to have an appropriately contoured form so constraining the outer end of the lance 5 to move in a predetermined manner to compensate for lance curvature as the exposed lance length increases and ensure that the lance tip moves substantially horizontally at a fixed distance from the heat exchange elements.

Figure 1C:
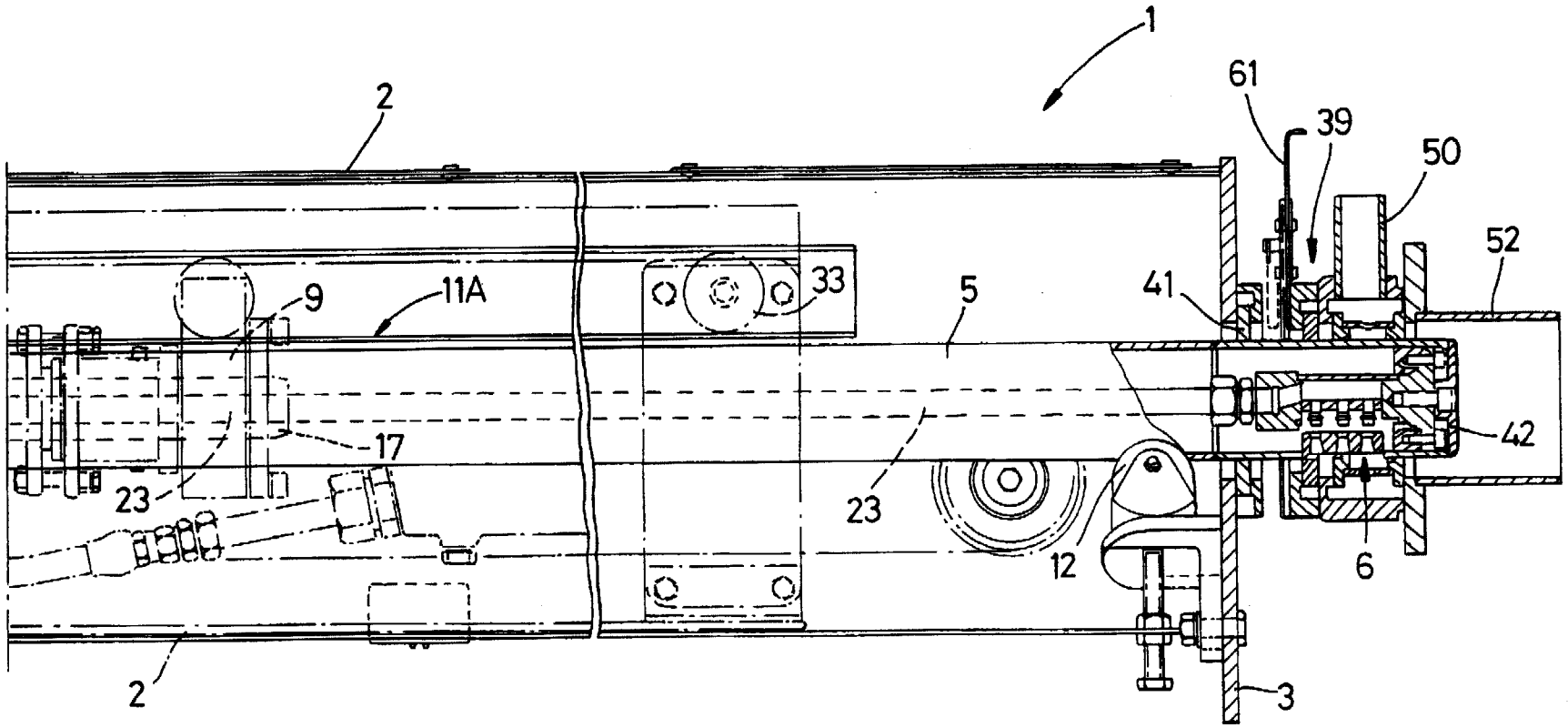
Figure 4A:
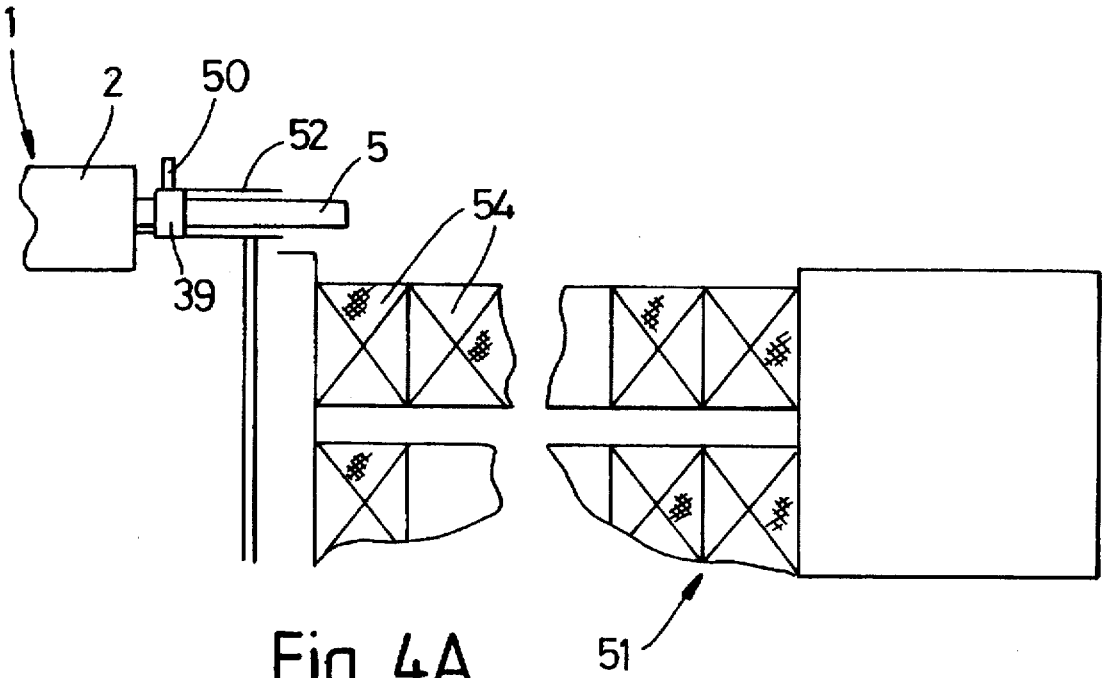
FIGS. 4A and 4B are schematic views of the sootblower in use in a rotary regenerative preheater.
Figure 4B:
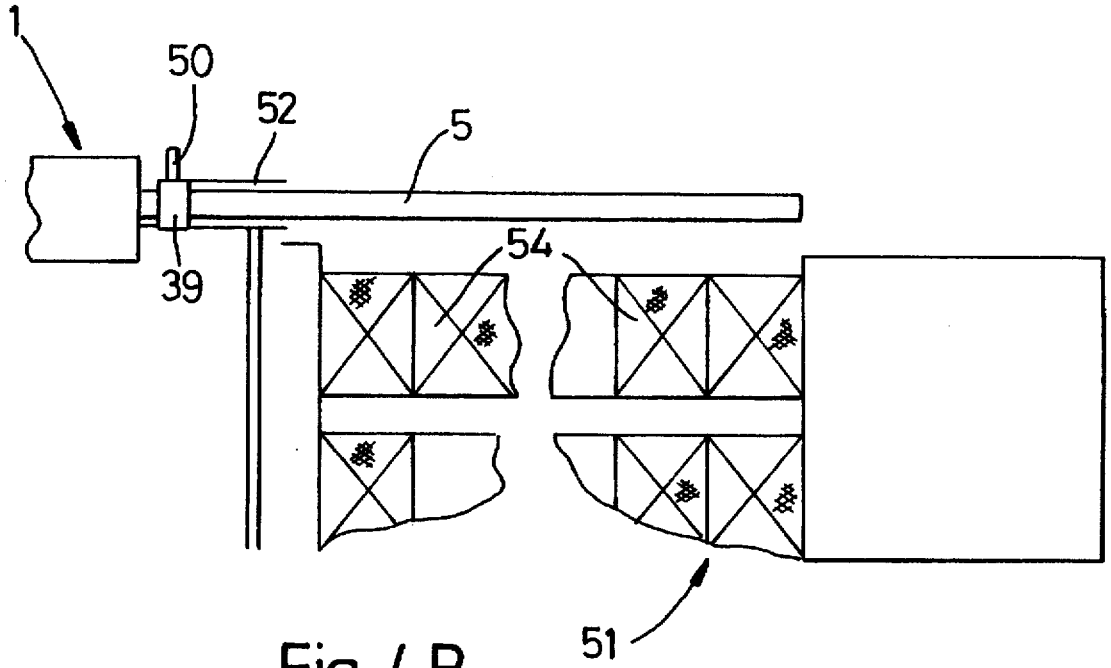

In operation of the sootblower 1 in a rotary regenerative heat exchanger 51 (FIGS. 4A/B) for example, the motor 7 is run to extend the lance 5 together with the carriage 31 of the pulley wheel 26 moving correspondingly, the lance 5 advancing through a duct casing 52, and at a selected position a trip switch 53 is actuated by the carriage 9 to cause appropriate cleaning medium to flow to the nozzle assembly 6 and to discharge as jets onto the drum supported heat exchanger plates 54—this position is indicated in FIG. 4A. The lance 5 is then advanced in indexed manner over the plates 54 to the position shown in FIG. 4B when a switch 55 is triggered to retract the lance 5. The retracting lance 5 re-triggers switch 53 to stop cleaning medium flow and ultimately triggers switch 56 to halt lance retraction, the lance inner end then being located in the wallbox 39 as shown in FIGS. 1C/2C. FIGS. 1A/B and 2A/B illustrate the carriages 9, 31 both in the retracted and advanced positions.

The number of the (main) nozzles 22, their throat diameter, their relative positions at the tip of the lance 5, and the size of the incremental movements of the lance are all selected to achieve optimum cleaning of the heat exchanger heat retaining plate elements 54 and inter-plate cavities. The requisite throat diameter of the main nozzles 22 is much larger than that required for the high pressure (secondary) nozzles 21, and this permits the high pressure water jets from the nozzles 21 to be discharged through the nozzles 22, by having the nozzles 21 aligned with the nozzles 22, each high pressure water jet passing through the throat of a corresponding main nozzle 22 substantially without interference. This leads to a very compact nozzle arrangement.

A further advantage is that, by virtue of the substantially fully retractable lance 5, lance removal is possible during heat exchanger operation and without requiring exchanger shut-down, to enable repair or replacement of parts for example to the lance tip or nozzle assembly 6 thereon. For withdrawal of the lance, a control valve 60 is actuated so that high pressure service air now flows To the wallbox 39 in place of the lower pressure sealing air and provides a screen until the lance has been removed. Additionally a sealing place 61 is slid down in guides 62 to close the outer opening at the ring 46.

I claim:

1. Cleaning apparatus for cleaning heat transfer surfaces in a heat exchanger and capable of handling several cleaning mediums of different characteristics, said cleaning apparatus comprising outlet means incorporating nozzle means for discharging cleaning mediums onto said heat transfer surfaces, conduit means for delivering cleaning mediums to said outlet means and inlet means for supplying cleaning mediums to the conduit means, said nozzle comprising two sets of discharge nozzles each of which sets is associated with a respective cleaning medium, a first one of said nozzle sets having nozzles for the discharge of relatively higher pressure medium, while the second nozzle set has nozzles of relatively larger throat diameter serving for the discharge of relatively lower pressure medium, said first and second nozzle sets being adapted for fluid communication with separate respective first and second conduit means, whereby each nozzle set receives its respective cleaning medium, said first conduit means being adapted to deliver high pressure water substantially without leakage, wherein said second nozzle set for the lower pressure medium is located downstream of said first nozzle set for the higher pressure medium, and wherein the nozzles of said second set are arranged coaxially with nozzles of said first set whereby cleaning medium discharge from the first nozzle set passes through the throats of the nozzles of the second nozzle set so enabling cleaning medium discharged selectively from both the nozzle sets to pass from the outlet means without substantial obstruction.

2. Cleaning apparatus as claimed in claim 1 wherein at least a portion of said first conduit means extends within said second conduit means.

3. Cleaning apparatus as claimed in claim 2 wherein said second conduit means includes a movable lance portion and a static input feed portion, and in that said first conduit means is movable and extends into said lance portion, said static conduit portion being off-set relative to said lance portion and having a section within said lance portion beside which section the first conduit means extend.

4. Cleaning apparatus as claimed in claim 3 wherein said lance portion ahd the first conduit means extend substantially concentrically adjacent said outlet means.

5. Cleaning apparatus as claimed in claim 3 wherein the first conduit means comprises a rigid tube part within said lance portion, and a flexible tube part sealingly connected at one end to the rigid part and located outwith said lance portion and secured at a static fixing point.

6. Cleaning apparatus as claimed in claim 5 wherein the flexible tube part passes around a pulley wheel being mounted for conforming movement with the lance portion while said static fixing point is spaced from the pulley wheel towards said outlet means.

7. Cleaning apparatus as claimed in claim 6 wherein drive means are provided for simultaneous linear movements of the lance portion and the pulley wheel.

8. Cleaning apparatus as claimed in claim 5 wherein a housing is provided at the side of the lance portion, said housing facilitating extension of the rigid tube part outwith the lance portion.

9. Cleaning apparatus as claimed in claim 3 wherein the end of said lance portion remote from the outlet means is secured to a support block of a carriage facilitating movement of the lance portion, said support block including an aperture for said static input feed portion such that said static feed portion enters the lance portion eccentrically, sealing means being provided for the static feed portion at the block.

10. Cleaning apparatus as claimed in claim 3 wherein support rollers are provided for the lance portion adjacent the outlet means.

11. Cleaning apparatus as claimed in claim 1 wherein each nozzle set comprises a plurality of nozzles, each nozzle of said first set discharging through the throat of a corresponding nozzle of the second set.

12. Cleaning apparatus as claimed in claim 1 wherein the nozzles sets are located in an outer end portion of the conduit means and are adapted to discharge laterally relative to said conduit means.

13. Cleaning apparatus as claimed in claim 12 wherein each nozzle set includes two side-by-side arrays of nozzles.

14. Cleaning apparatus as claimed in claim 12 including a primary casing means and wherein the conduit means are movable longitudinally relative to said primary casing means of the cleaning apparatus to vary the position of the outlet means and in a retracted position are located substantially wholly within said primary casing means with only a tip portion located externally.

15. Cleaning apparatus as claimed in claim 14 wherein the tip portion comprises material resistant to corrosion in a hostile environment.

16. Cleaning apparatus as claimed in claim 14 wherein the outer end portion of the conduit means with the nozzle sets is located within a dedicated static protective cover of the casing means in the retracted condition of the conduit means.

17. Cleaning apparatus as claimed in claim 16 wherein the protective cover comprises an annular shroud and an end wall, the end wall including an aperture for through passage of the conduit means.

18. Cleaning apparatus as claimed in claim 16 wherein the protective cover is adapted to receive a flow of sealing medium via an inlet.

19. A heat exchanger including a cleaning apparatus for cleaning heat transfer surfaces of the heat exchanger, said cleaning apparatus comprising outlet means incorporating nozzle means for discharging cleaning mediums onto said heat transfer surfaces, conduit means for delivering cleaning mediums to said outlet means and inlet means for supplying cleaning mediums to the conduit means, said nozzle comprising two sets of discharge nozzles each of which sets is associated with a respective cleaning medium a first one of said nozzle sets having nozzles for the discharge of relatively higher pressure medium, while the second nozzle set has nozzles of relatively larger throat diameter serving for the discharge of relatively lower pressure medium, said first and second nozzle sets being adapted for fluid communication with separate respective first and second conduit means whereby each nozzle set receives its respective cleaning medium, said first conduit means being adapted to deliver high pressure water substantially without leakage wherein said second nozzle set for the lower pressure medium is located downstream of said first nozzle set for the higher pressure medium, and in that nozzles of said second set are arranged coaxially with nozzles of said first set whereby cleaning medium discharge from the first nozzle set passes through the throats of the nozzles of the second nozzle set so enabling cleaning medium discharged selectively from both the nozzle sets to pass from the outlet means without substantial obstruction.

20. Cleaning apparatus for cleaning heat transfer surfaces in a heat exchanger and capable of handling several cleaning mediums of different characteristics, said cleaning apparatus comprising outlet means incorporating nozzle means for discharging cleaning mediums onto said heat transfer surfaces, conduit means for delivering cleaning mediums to said outlet means and inlet means for supplying cleaning mediums to the conduit means, said nozzle means comprising two sets of discharge means each of which sets is associated with a respective cleaning medium, a first one of said nozzle sets having nozzles for the discharge of relatively higher pressure medium, while the second nozzle set has nozzles serving for the discharge of relatively lower pressure medium, said first and second nozzle sets being adapted for fluid communication with separate respective first and second conduit means, whereby each nozzle set receives its respective cleaning medium, at least a portion of said first conduit means extending within said second conduit means, said second conduit means including a moveable lance portion and a static input feed portion, said first conduit means being moveable and extending into said lance portion, said static conduit portions being off-set relative to the centre-line of said lance portion and having a section within said lance portion beside which section the first conduit means extend.

21. Cleaning apparatus for cleaning heat transfer surfaces in a heat exchanger and capable of handling several cleaning mediums of different characteristics, said cleaning apparatus comprising outlet means incorporating nozzle means for discharging cleaning mediums onto said heat transfer surfaces, conduit means for delivering cleaning mediums to said outlet means and inlet means for supplying cleaning mediums to the conduit means, said nozzle means comprising two sets of discharge nozzles each of which sets is associated with a respective cleaning medium a first one of said nozzle sets having nozzles for the discharge of relatively higher pressure medium, while the second nozzle set has nozzles serving for the discharge of relatively lower pressure medium, said first and second nozzle sets being adapted for fluid communication with separate respective first and second conduit means, whereby each nozzle set receives its respective cleaning medium, said first conduit means including a rigid tube part connecting with the first nozzle set and a flexible tube part sealingly coupled at one end to the rigid tube part and passing around a pulley wheel with the other end of the flexible tube part secured at a static fixing point, an extendible member for the first nozzle set for movement of the first nozzle set between retracted and advanced positions, and a carriage for the pulley wheel adapted to move with said extendible member but at a reduced speed relative thereto.

22. A heat exchanger including cleaning apparatus for cleaning heat transfer surfaces of the heat exchanger said cleaning apparatus comprising cleaning apparatus for cleaning heat transfer surfaces in a heat exchanger and capable of handling several cleaning mediums of different characteristics, said cleaning apparatus comprising outlet means incorporating nozzle means for discharging cleaning mediums onto said heat transfer surfaces, conduit means for delivering cleaning mediums to said outlet means and inlet means for supplying cleaning mediums to the conduit means, said nozzle means comprising two sets of discharge nozzles each of which sets is associated with a respective cleaning medium, a first one of said nozzle sets having nozzles for the discharge of relatively higher pressure medium, while the second nozzle set has nozzles serving for the discharge of relatively lower pressure medium, said first and second nozzle sets being adapted for fluid communication with separate respective first and second conduit means, whereby each nozzle set receives its respective cleaning medium, at least a portion of said first conduit means extending within said second conduit means said second conduit means including a moveable lance portion and a static input feed portion, said first conduit means being moveable and extending into said lance portion, said static conduit portions being off-set relative to the centre-line of said lance portion and having a section within said lance portion beside which section the first conduit means extend.

23. A heat exchanger including cleaning apparatus for cleaning heat transfer surfaces of the heat exchanger, said cleaning apparatus comprising cleaning apparatus for cleaning heat transfer surfaces in a heat exchanger and capable of handling several cleaning mediums of different characteristic, said cleaning apparatus comprising outlet means incorporating nozzle means for discharging cleaning mediums onto said heat transfer surfaces, conduit means for delivering cleaning mediums to said outlet means and inlet means for supplying cleaning mediums to the conduit means said nozzle means comprising two sets of discharge nozzles each of which sets is associated with a respective cleaning medium, a first one of said nozzle sets having nozzles for discharge of relatively higher pressure medium, while the second nozzle set has nozzles serving for the discharge of relatively lower pressure medium medium said first and second nozzle sets being adapted for fluid communication with separate respective first and second conduit means, whereby each nozzle set receives its respective cleaning medium, said first conduit means including a rigid tube part connecting with the first nozzle set and a flexible tube part sealingly coupled at one end to the rigid tube part and passing around a pulley wheel with the other end of the flexible tube part secured at a static fixing point, an extendible member for the first nozzle set for movement of the first nozzle set between retracted and advanced positions and a carriage for the pulley wheel adapted to move with said extendible member but at reduced speed relative thereto.

* * * * *